US010349746B2

(12) United States Patent
Koehler et al.

(10) Patent No.: US 10,349,746 B2
(45) Date of Patent: Jul. 16, 2019

(54) PIVOTING GANGING ARMS FOR CHAIRS

(71) Applicant: Krueger International, Inc., Green Bay, WI (US)

(72) Inventors: Karl Joseph Koehler, Brillion, WI (US); Timothy Joseph Bouche, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 144 days.

(21) Appl. No.: 15/431,252

(22) Filed: Feb. 13, 2017

(65) Prior Publication Data

US 2018/0228291 A1 Aug. 16, 2018

(51) Int. Cl.

| | |
|---|---|
| ***A47C 15/00*** | (2006.01) |
| ***A47C 1/124*** | (2006.01) |
| ***A47C 7/16*** | (2006.01) |
| ***A47C 3/04*** | (2006.01) |

(52) U.S. Cl.

CPC ..... *A47C 1/124* (2013.01); *A47C 3/04* (2013.01); *A47C 7/16* (2013.01)

(58) Field of Classification Search

CPC ..... A47C 1/124; A47C 7/62; A47C 3/04

USPC ..... 297/188.01, 248, 249, 232, 257, 188.2, 297/188.12, 188.06; 108/64

See application file for complete search history.

(56) References Cited

U.S. PATENT DOCUMENTS

| | | | | |
|---|---|---|---|---|
| 3,314,718 | A * | 4/1967 | Crandall | A47C 1/124 297/239 |
| 3,614,157 | A * | 10/1971 | Hendrickson | A47C 1/124 297/248 |
| 4,978,168 | A | 12/1990 | Piretti | |
| 5,282,669 | A * | 2/1994 | Barile | A47C 3/04 297/248 |
| 5,957,530 | A * | 9/1999 | Gutgsell | A47C 1/124 297/232 |
| 6,048,127 | A | 4/2000 | Kern et al. | |
| 7,810,882 | B2 * | 10/2010 | Bartlmae | A47C 3/04 297/239 |
| 9,144,311 | B2 | 9/2015 | Romero | |
| 9,173,494 | B2 | 11/2015 | Fahlstedt | |
| 9,282,823 | B2 * | 3/2016 | Kumazawa | A47C 1/124 |
| 9,351,577 | B2 | 5/2016 | Rogers | |
| 10,021,981 | B1 * | 7/2018 | Zheng | A47C 1/124 |
| 2005/0012371 | A1 * | 1/2005 | Mendenhall | A47C 1/124 297/248 |
| 2012/0286551 | A1 * | 11/2012 | Kumazawa | A47C 1/124 297/248 |
| 2014/0152059 | A1 | 6/2014 | Swy | |

(Continued)

*Primary Examiner* — Chi Q Nguyen

(74) *Attorney, Agent, or Firm* — Andrus Intellectual Property Law, LLP

(57) ABSTRACT

A chair includes a frame having a plurality of legs, a seat coupled to the frame that includes a seating surface and opposing side edges, and at least one ganging arm. The ganging arm is configured to pivot about a pivot axis into and between an operative position in which the ganging arm extends laterally from one of the opposing side edges and a storage position in which the ganging arm is beneath the seat. In one embodiment, the chair includes a pair of ganging arm, where a first ganging arm includes a male ganging end and the second ganging arm includes a female ganging end. Each of the ganging arms is mounted for rotation about a mounting device attached to the frame of the chair.

20 Claims, 7 Drawing Sheets

(56) References Cited

U.S. PATENT DOCUMENTS

| | | | | |
|---|---|---|---|---|
| 2014/0175848 | A1* | 6/2014 | Motta | A47C 1/124<br>297/248 |
| 2014/0361588 | A1* | 12/2014 | Romero | A47C 1/03294<br>297/248 |
| 2015/0296986 | A1* | 10/2015 | Rogers | A47C 1/124<br>297/239 |

* cited by examiner

PIVOTING GANGING ARMS FOR CHAIRS

BACKGROUND

The present disclosure generally relates to chairs having a seat and a seatback and at least one pivoting ganging arm. More specifically, the present disclosure relates to chairs that include pivoting ganging arms that are movable into and between a storage position in which the ganging arm is positioned beneath the seat and an operative position in which the ganging arm extends laterally from one side edge of the seat.

Typically, low cost stacking chairs are used to create rows of seating, and often, the chairs include some type of ganging mechanism that joins, couples, and/or "gangs" the chairs together to define the desired rows. Various types of ganging devices have been developed to link chairs together in such a manner. However, many of these ganging devices include some type of bracket that extends from the side of the chair, which can create problems when the chairs are not used in a ganged application.

The present inventors have recognized that conventional low cost stacking chairs do not include chair ganging devices that can be selectively moved into and between the storage position and the operative position. Accordingly, the present inventors have developed the ganging arms of the present disclosure that can be selectively moved into and between a storage position in which the ganging arm is positioned beneath the seat of the chair and an operative position in which the ganging arm extends from one of the side edges of the seat.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a chair includes a frame having a plurality of legs, a seat coupled to the frame and having opposing side edges, and at least one ganging arm. The ganging arm is configured to pivot into and between an operable position in which the ganging arm extends laterally from one of the opposing side edges of the seat and a storage position in which the ganging arm is positioned beneath the seat.

In certain examples, a chair includes a frame having a plurality of legs and a seat coupled to the frame and having a seating surface, a first opposing side edge and a second opposing side edge opposite the first opposing side edge. A first ganging arm is configured to pivot about a pivot axis that is perpendicular to the seating surface into and between an operable position in which the first ganging arm extends from the first opposing side edge and a storage position in which the first ganging arm is beneath the seat. A second ganging arm is configured to pivot about a second pivot axis that is parallel to the first pivot axis into and between an operable position in which the second ganging arm extends from the second opposing side edge and a storage position in which the second ganging arm is beneath the seat.

In certain examples, a chair includes a frame having a plurality of legs and a seat having opposing side edges. A ganging arm is configured to pivot about a vertical pivot axis into and between an operable position in which the ganging arm extends from one of the opposing side edges and a storage position in which the ganging arm is beneath the seat. The ganging arm has a ganging end that extends from one of the opposing side edges of the seat and an attachment end opposite the ganging end. A mounting device couples the ganging arm to the chair and defines the vertical pivot axis. The mounting device has a first end that couples to the chair and a second end opposite the first end. The attachment end of the ganging arm is disposed on the mounting device between the first end and the second end of the mounting device such that the ganging arm pivots about the vertical pivot axis.

BRIEF DESCRIPTION OF THE DRAWINGS

The drawings illustrate the best mode presently contemplated of carrying out the disclosure. In the drawings.

DETAILED DESCRIPTION

Figure 1:
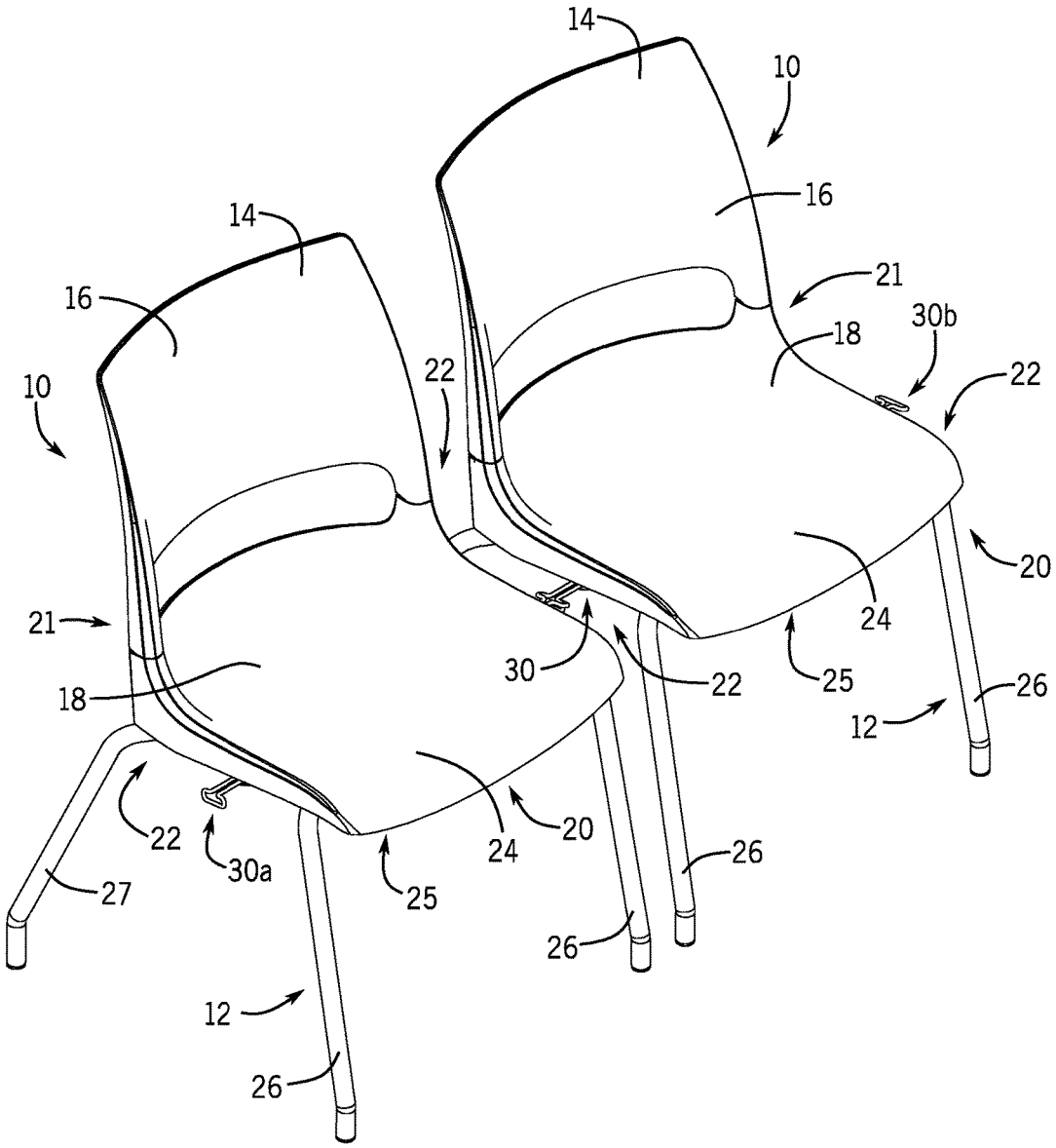
FIG. 1 is a perspective view of two chairs "ganged" together by example ganging arms of the present disclosure.
Figure 2:
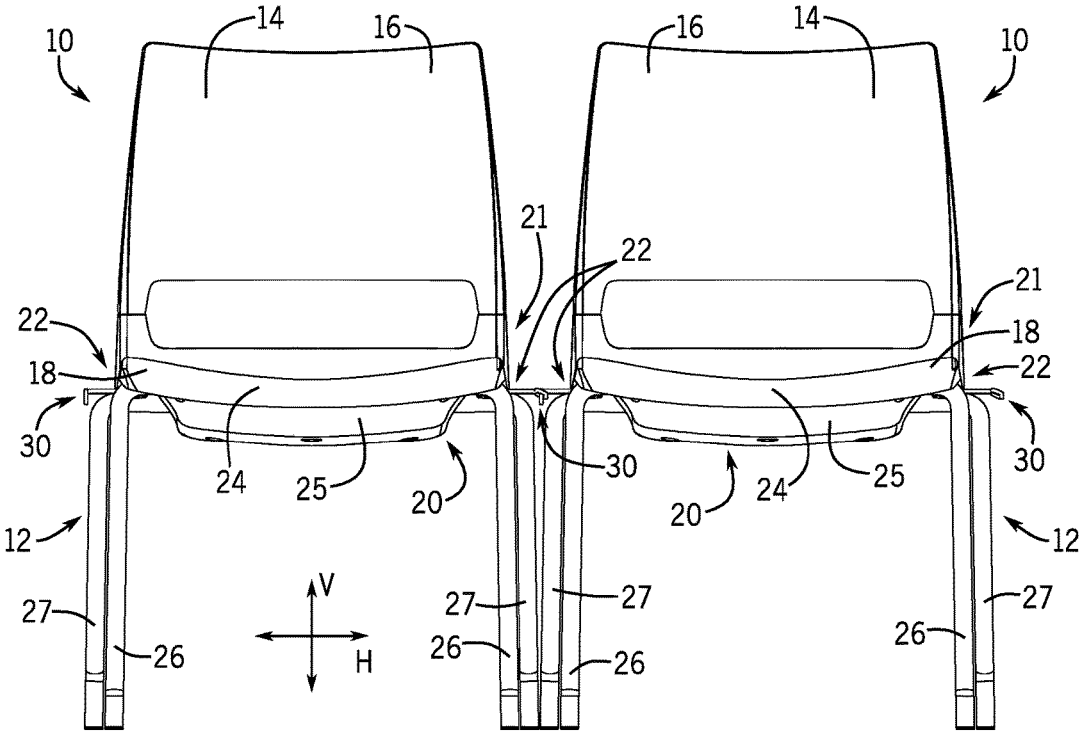
FIG. 2 is a front view similar to FIG. 1.
Figure 3:
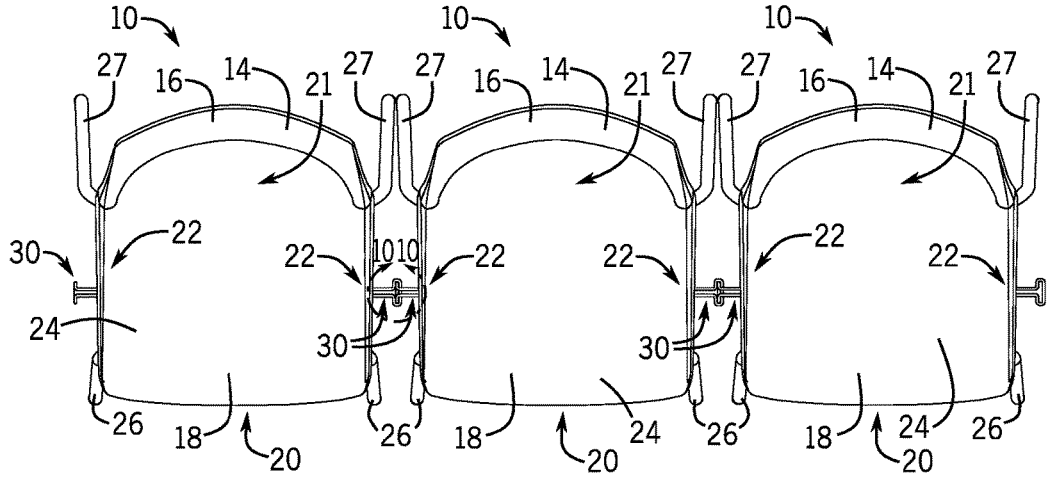
FIG. 3 is a top view similar to FIG. 1 with three chairs "ganged" together.

FIGS. 1-3 depict chairs 10 positioned adjacent to each other and "ganged" or coupled together by ganging arms 30. Each chair 10 includes a frame 12 that supports an integrally molded shell 14 in the embodiment shown in the Figures. The frame 12 includes four legs (e.g. a pair of front legs 26 and a pair of rear legs 27). The shell 14 is molded from a plastic material and includes a seatback 16 and a seat 18. Although the shell 14 is shown including both the seatback 16 and seat 18, the seatback 16 and seat 18 could be separate components that are separately mounted to the frame 12. The seat 18 has a front 20, a back 21 opposite the front 20, and opposing side edges 22 that extend between the front 20 and the back 21. The seat 18 has a generally horizontal seating surface 24 on which a user sits when using the chair 10 and a lower surface 25 opposite the seating surface 24.

Figure 4:
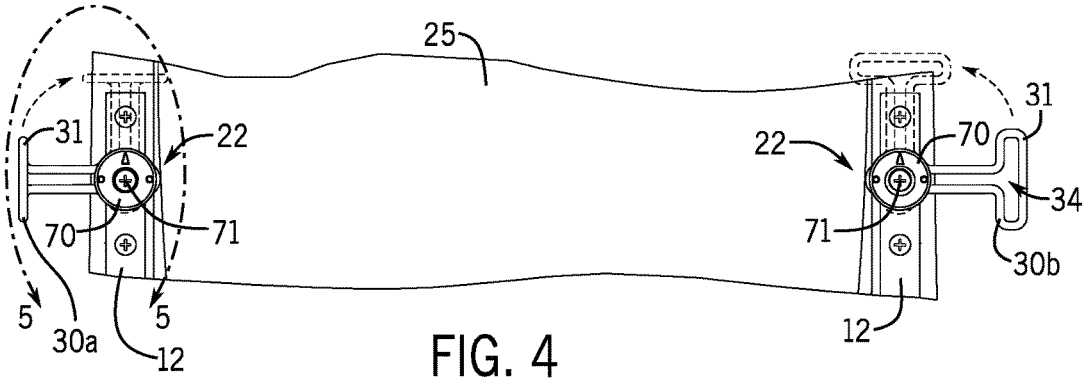
FIG. 4 is a bottom view of a chair with two ganging arms in an operative position (see solid lines) and a storage position (see dashed lines)
Figure 5:
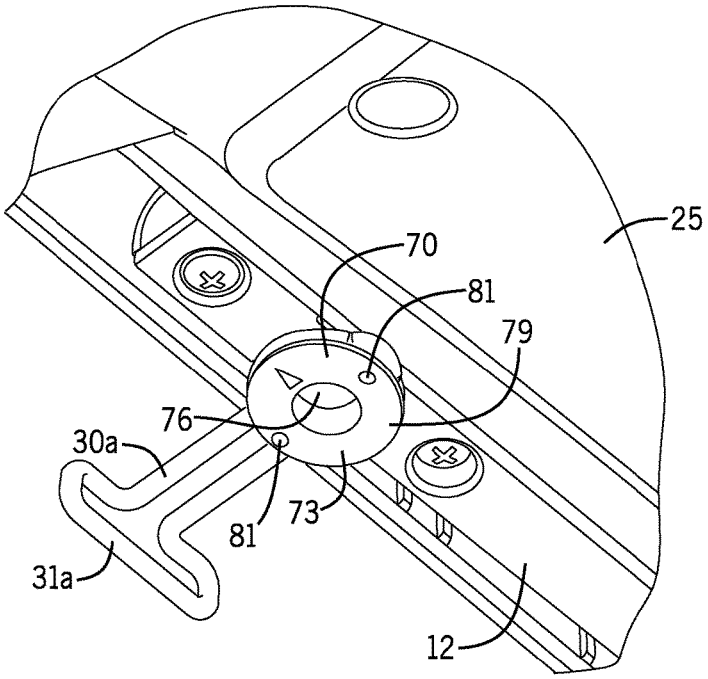
FIG. 5 is an enlarged perspective view within line 5-5 on FIG. 4.

Referring to FIGS. 4-5, each chair 10 includes a two ganging arms 30*a*, 30*b* that are each pivotably coupled to the frame 12 near each of the opposing side edges 22 of the seat, respectively. Each of the first and second ganging arms 30*a*, 30*b* is configured to pivot into and between an operable position (see first ganging arm 30*a* in solid-line in FIG. 4)

and a storage position (see first ganging arm 30*a* in dashed-line in FIG. 4) (note dashed-line arrow that shows the ganging arm 30 pivoting from the operable position to the storage position). In the operative position, the first and second ganging arms 30*a*, 30*b* extend laterally past the opposing side edges 22 of the seat 18 and are configured to couple to adjacent chairs 10 and/or ganging arms 30 to thereby prevent or restrict separation of the chairs 10. When the ganging arms 30 are in the storage position, the ganging arms 30 are beneath the seat such that the chairs 10 can be used independently without worry of damaging the ganging arms 30.

Figure 6:
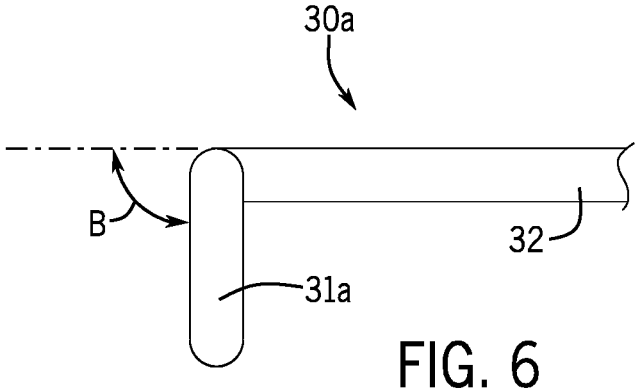
FIG. 6 is a side view of an example ganging arm with a male ganging end.
Figure 7:
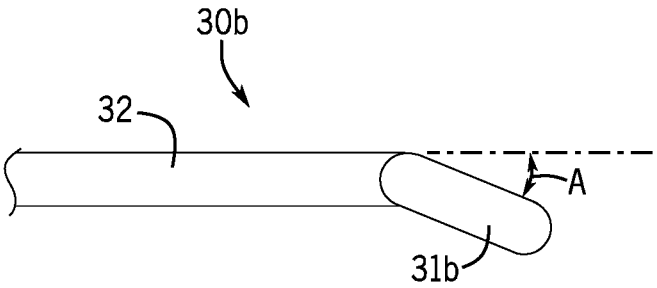
FIG. 7 is a side view of an example ganging arm with a female ganging end.
Figure 8:
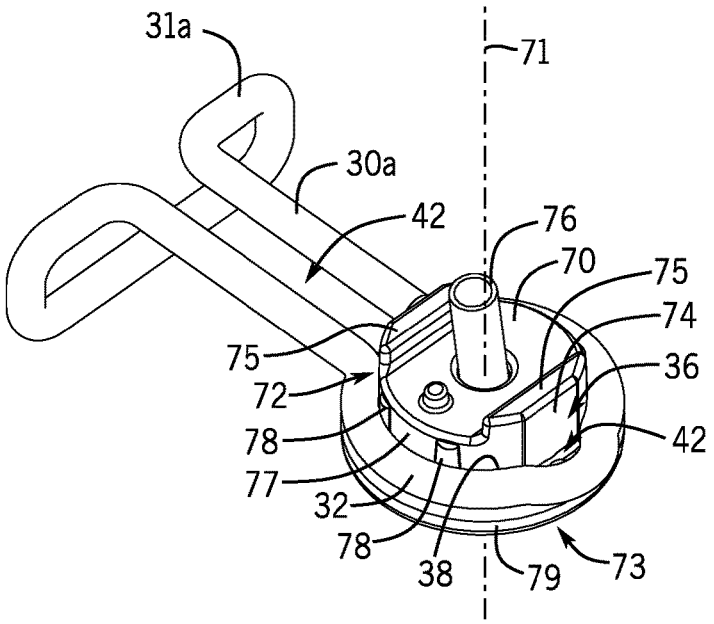
FIG. 8 is a perspective view of an example ganging arm with a male ganging end.
Figure 9:
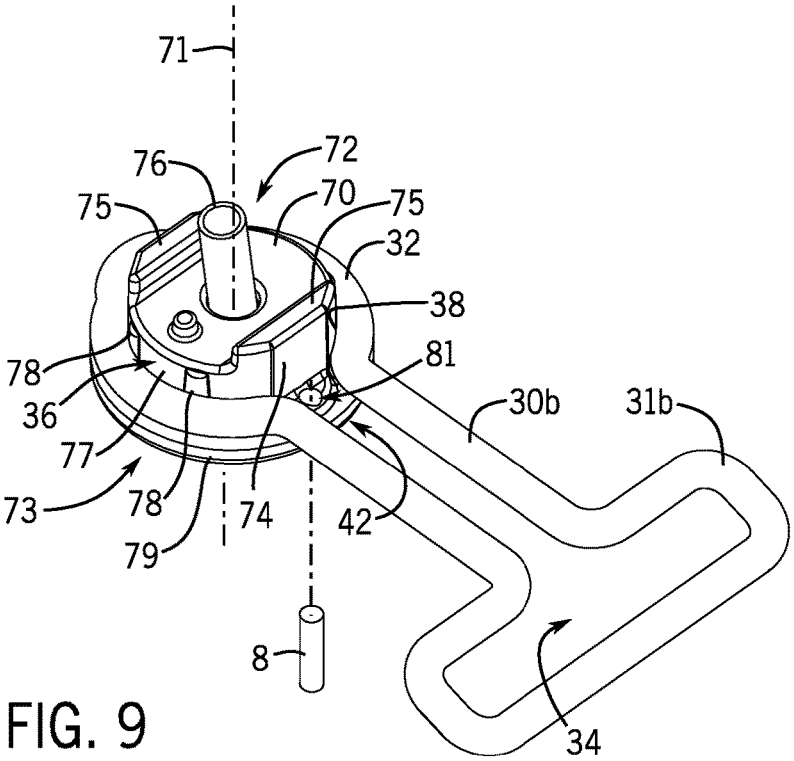
FIG. 9 is a perspective view of an example ganging arm with a female ganging end.

Each ganging arm 30 is disposed on and coupled to the frame 12 by a mounting device 70 (described further herein). The first ganging arm 30*a* has a ganging end 31*a* that is configured to extend laterally past one of the opposing side edges 22 of the chair 10 when the ganging arm 30*a* is in the operative position. The first second arm 30*b* has a ganging end 31*b* that is configured to extend laterally past the opposite side edge 22 of the chair 10 when the ganging arm 30*b* is in the operative position. Each of the two ganging arms 30 coupled to the chair 10 has a distinct and different ganging end 31. That is, the first ganging arm 30*a* has a male ganging end 31*a* (FIGS. 6 & 8) and the second ganging arm 30*b* has a female ganging end 31*b* (FIGS. 7 & 9). As such, adjacent chairs 10 can be coupled together by mating the female ganging end 31*b* (FIGS. 7 & 9) of the second ganging arm 30*b* on a first chair 10 with a male ganging end 31*a* (FIGS. 6 & 8) of the first ganging arm 30*a* on a second adjacent chair 10 (FIG. 2). In the embodiment shown, the chairs 10 are each configured such that the first ganging arm 30*a* extends from the right side of the chair 10 while the second ganging arm 30*b* extends from the left side of the chair 10.

In the instance of a ganging arm 30*b* with a female ganging end 31*b* (FIGS. 7 & 9), the female ganging end 31*b* is orientated at an angle A relative to an attachment end 32 (described herein). That is, the female ganging end 31*b* is bent such that the plane of the female ganging end 31*b* is transverse to the plane of the attachment end 32 at an angle A. The angle A can vary, and in the depicted example (FIG. 7) angle A is less than 90 degrees. The female ganging end 31*b* defines a ganging opening 34 (FIG. 9) that is configured to receive the male ganging end 31*a*.

Figure 10:
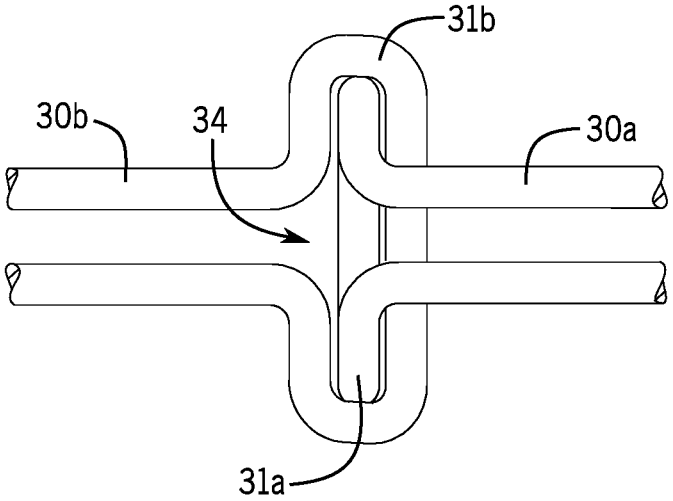
FIG. 10 is an enlarged view within line 10-10 on FIG. 3 showing a first ganging arm with a male ganging end mating with a second ganging arm with a female ganging end.

In the instance of a ganging arm 30*a* with a male ganging end 31*a* (FIGS. 6 & 8), the male ganging end 31*a* is orientated at an angle B relative to the attachment end 32 such that the male ganging end 31*a* is configured to mate with the female ganging end 31*b* (FIGS. 7 & 9). The angle B can vary, and in the depicted example (FIG. 6) the angle B is perpendicular relative to the attachment end 32. That is, the male ganging end 31*a* is bent such that the plane of the male ganging end 31*a* is perpendicular to the plane of the attachment end 32. The male ganging end 31*a* is sized such that the male ganging end 31*a* mates with or is received in the ganging opening 34 of the female ganging end 31*b* (FIG. 10). It will be recognized that the size, shape, and orientation of the male ganging end 31*a* (FIGS. 6 & 8) and/or female ganging end 31*b* (FIGS. 7 & 9) can vary.

Each ganging arm 30 has a similar attachment end 32 opposite the ganging end 31. The attachment end 32 is disposed on the mounting device 70 (described further herein). The attachment end 32 is substantially circular and defines a bore 36 such that the attachment end 32 has an inner surface 38. The attachment end 32 is formed to include at least one set-pin opening 42 (described further herein). The ganging arms 30 can be made from any suitable material such as ceramic, plastic, glass, metal and/or the like. In the example depicted, the ganging arms 30 are each formed from a metal wire-form material.

The chair 10 includes two mounting devices 70 (FIG. 11) that are configured to couple the first and second ganging arms 30*a*, 30*b* to the frame 12 (FIGS. 4-5). Each mounting device 70 defines a pivot axis 71 (FIG. 11) about which the ganging arm 30 pivots between the operative position and the storage position (FIG. 4). The pivot axis 71 is generally perpendicular to a seating plane defined by the seating surface of the seat 18. When the chair 10 is supported on a horizontal surface, such as a floor, the pivot axis 71 is generally vertical and a seating plane defined by the seat 18 is generally horizontal.

In operation, the each ganging arm 30 is able to pivot 90 degrees about the pivot axis 71 from the operation position in which the ganging arm 30 extends laterally from the side edge 22 of the seat 18. This pivoting movement allows the ganging arm to move between the operable position and the storage position. In certain examples, the physical configuration of the bottom surface of the seat prevents the ganging arm 30 from pivoting past the storage position (i.e. preventing the ganging arm 30 from pivoting more than 90 degrees.

Figure 11:
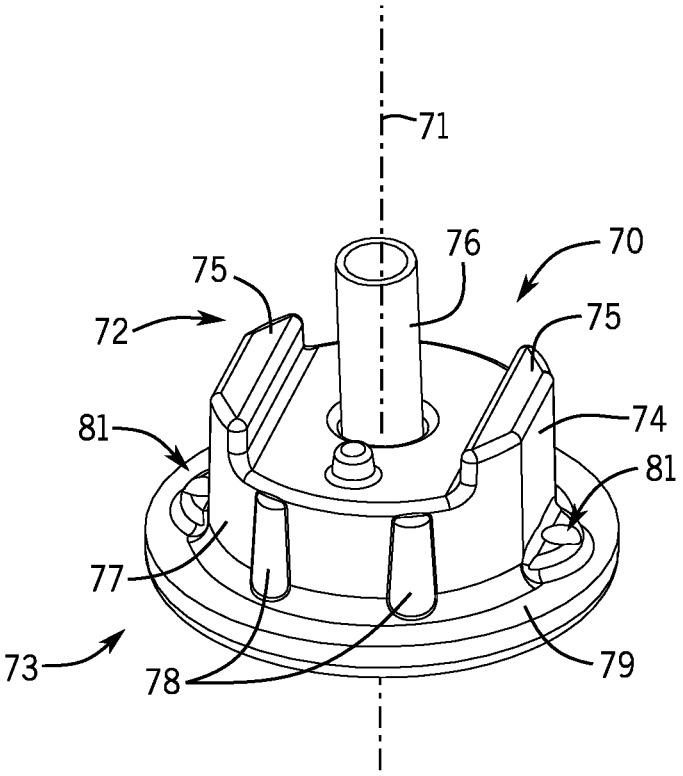
FIG. 11 is a perspective view of an example mounting device.

Referring to FIG. 11, the mounting device 70 has a first end 72 that couples to the frame 12 (FIGS. 4-5), a second end 73 opposite the first end 72, and a hub 74 extending between the first end 72 and the second end 73 along the pivot axis 71. The first end 72 has a pair of fingers 75 configured to engage the frame 12. In certain examples, the fingers 75 are configured to elastically deform as the mounting device 70 is coupled to the frame 12 (i.e. the fingers 47 elastically deform to "snap" fit onto the frame 12). The first end 72 includes a sleeve 76 configured to guide a mechanical fastener (e.g. screw, rivet) (not shown) into position whereby the mechanical fastener couples the mounting device 70 to the frame 12.

The hub 74 of the mounting device 70 has an outer wear surface 77 that extends between the first end 72 and the second end 73 along the pivot axis 71. In operation, the attachment end 32 of the ganging arm 30 is disposed on the mounting device 70 such that the inner surface 38 of the attachment end 32 contacts the wear surface 77 of the hub 74 (FIGS. 8-9). In certain examples, the attachment end 32 is disposed on the mounting device 70 such that the inner surface 38 tightly contacts the wear surface 77 such that a pivoting force must be applied by the operator in order to move the ganging arm 30 into and between the operative position and the ganging position (i.e. the inner surface 38 and wear surface 77 frictionally engage with each other such that the ganging arm 30 does not freely/loosely pivot). The wear surface 77 includes a plurality of bumps 78 (FIG. 11) that increases contact and/or friction between the wear surface 77 and the inner surface 38.

The second end 73 of the mounting device 70 includes a flange 79 configured to retain the attachment end 32 of the ganging arm 30 on the mounting device 70. That is, the flange 79 is configured to prevent the attachment end 32 of the ganging arm 30 (which is disposed on the hub 74 between the first end 72 and the second end 73) from sliding off the mounting device 70 in a direction along the pivot axis 71 away from the first end 72 (FIGS. 4-5). As such, the attachment end 32 of the ganging arm is retained or sandwiched between the flange 79 and the frame 12. The flange 79 has an outside radius R1 that is greater than an outside radius R2 of the first end 44 (FIG. 12).

Figure 12:
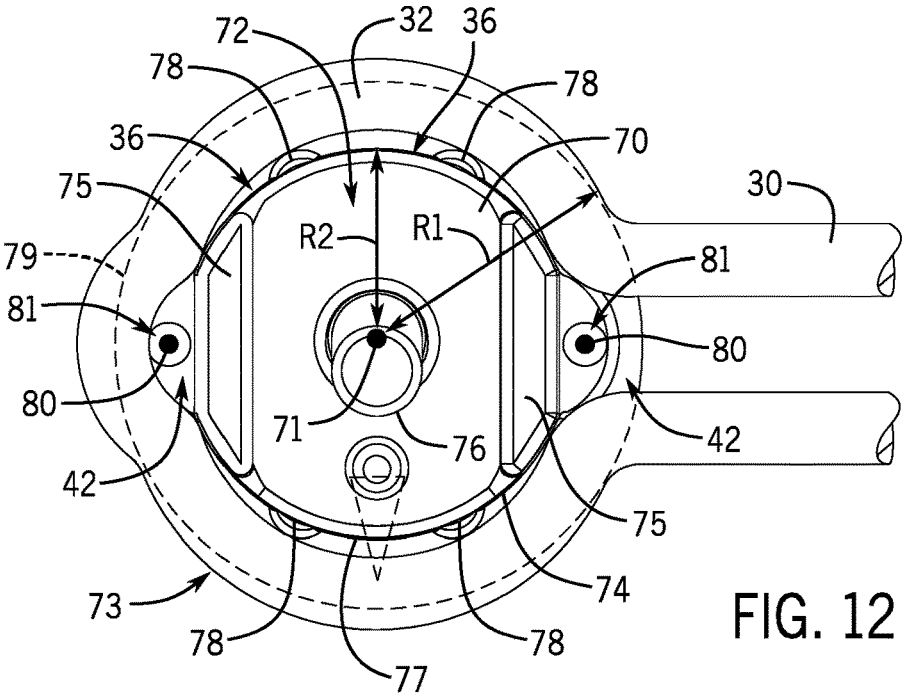
FIG. 12 is a partial bottom view of an example ganging arm in an operative position.
Figure 13:
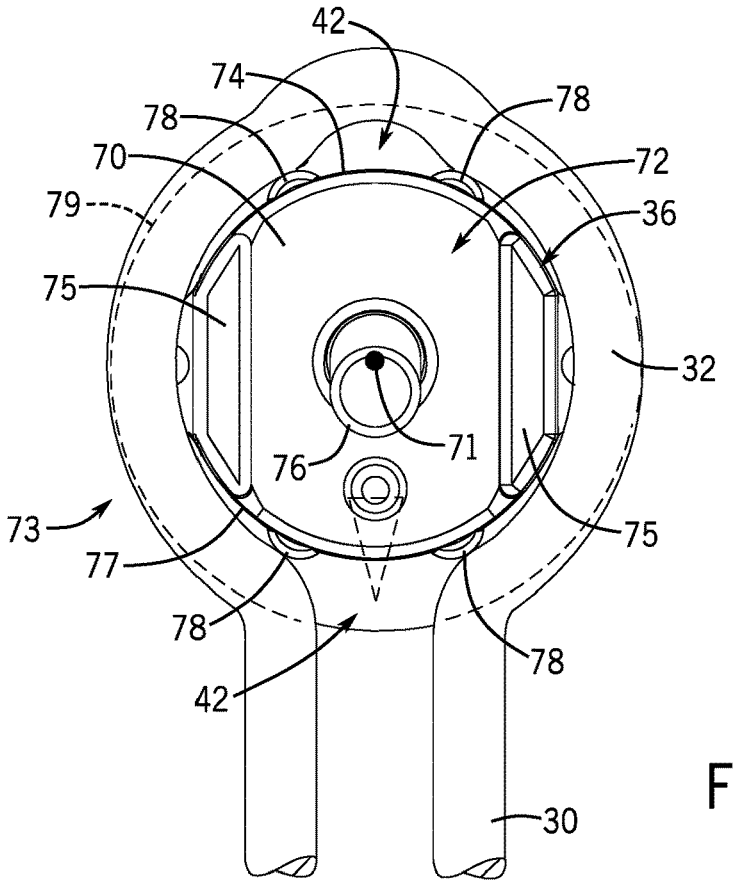
FIG. 13 is a partial bottom view of an example ganging arm in a storage position.

Referring to FIGS. 9 and 12-13, the chair 10 optionally includes a set-pin 80 that is configured to selectively "lock"

the ganging arm 30 in the operative position (FIG. 12) (i.e. the set-pin 80 prevents the ganging arm 30 from pivoting from the operative position (FIG. 12) to the storage position (FIG. 13). In operation, the ganging arm 30 is pivoted into the operative position (FIG. 12) such that a set-pin opening 42 defined in the attachment end 32 of the ganging arm 30 aligns with a set-pin hole 81 defined in the flange 79. The set-pin 80 is then inserted into the set-pin opening 42 and the set-pin hole 81 to prevent the attachment end 32 of the ganging arm 30 from rotating relative to the pivot axis 43 and the ganging arm 30 from pivoting from the operative position to the storage position. Referring specifically to FIG. 13, the set-pin openings 42 and the set-pin holes 81 are misaligned (i.e. the attachment end 32 of the ganging arm 30 covers the set-pin holes 81) when the ganging arm 30 is in the storage position such that the set-pin 80 cannot be installed to prevent pivoting of the ganging arm 30 from the storage position to the operative position (FIG. 12). The number of the set-pin opening 42, the set-pins 80, and the set-pin holes 81 can vary. The set-pin 80 and/or the set-pin hole 81 defined in the flange 79 can each include corresponding screw threads that engage with each other. In certain examples, set-pin 80 is a spring pin (not shown) that has a spring configured to bias a rod toward the set-pin opening 42 defined by the attachment end 32. That is, the spring pin is configured to automatically move the rod into the set-pin opening 42 when the ganging arm 30 pivots to the operative position to thereby prevent the ganging arm 30 from pivoting from the operative position to the storage position. In this example, in order to pivot the ganging arm 30 from the operative position to the storage position, a force must be applied to the spring pin such that the spring compresses and the rod moves away from the set-pin opening 42.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A chair comprising:

a frame having a plurality of legs;

a seat coupled to the frame and having opposing side edges and a seating surface that defines a horizontal seating plane; and a ganging arm configured to pivot about a vertical pivot axis that is perpendicular to the seating plane defined by the seating surface, the ganging arm being movable between an operative position in which the ganging arm extends from one of the opposing side edges and a storage position in which the ganging arm is beneath the seat.

2. The chair according to claim 1, further comprising a mounting device that couples the ganging arm to the frame and defines the pivot axis about which the ganging arm pivots.

3. The chair according to claim 2, wherein the ganging arm pivots 90 degrees about the pivot axis.

4. The chair according to claim 2, wherein the ganging arm has a ganging end and an attachment end opposite the ganging end, the ganging end disposed on the mounting device such that the ganging arm rotates about the mounting device.

5. The chair according to claim 4, wherein the mounting device has a flange configured to retain the attachment end of the ganging arm on the mounting device.

6. The chair according to claim 5, wherein the flange has an outside radius that is greater than an internal radius of the attachment end of the ganging arm.

7. The chair according to claim 4, wherein the mounting device has a wear surface and the attachment end of the ganging arm includes an inner surface, wherein the inner surface frictionally engages the wear surface as the ganging arm pivots.

8. The chair according to claim 7, wherein the wear surface has a bump that increases friction between the wear surface and the inner surface as the ganging arm pivots.

9. The chair according to claim 5, wherein the flange defines a set-pin hole; and further comprising a set-pin that is selectively disposed in the set-pin hole to thereby prevent the ganging arm from pivoting from the operative position to the storage position.

10. The chair according to claim 9, wherein the attachment end defines a set-pin opening that aligns with the set-pin hole when the ganging arm is in the operative position; and wherein the set-pin is selectively disposed in the set-pin hole and the set-pin opening to thereby prevent the ganging arm from pivoting from the operative position to the storage position.

11. The chair according to claim 10, wherein the attachment end is configured to cover the set-pin hole of the flange when the ganging arm is in the storage position such that ganging arm freely pivots to the operative position.

12. A chair comprising:

a frame having a plurality of legs;

a seat coupled to the frame and having a seating surface that defines a horizontal seating plane, a first opposing side edge and a second opposing side edge opposite the first opposing side edge;

a first ganging arm configured to pivot about a first pivot axis that is vertical and perpendicular to the seating surface, the first ganging arm being movable between an operative position in which the first ganging arm extends laterally from the first opposing side edge and a storage position in which the first ganging arm is beneath the seat; and a second ganging arm configured to pivot about a second pivot axis that is vertical and perpendicular to the seating surface, the second ganging arm being moveable between an operative position in which the second ganging arm extends laterally from the second opposing side edge and a storage position in which the second ganging arm is beneath the seat.

13. The chair according to claim 12, wherein the first ganging arm has a ganging end that defines a ganging opening configured to receive a second ganging arm of a first adjacent chair.

14. The chair according to claim 13, wherein the second ganging arm has a ganging end that is configured to be received by the first ganging arm of a second adjacent chair that is opposite the first adjacent chair.

15. The chair according to claim 12, further comprising a first mounting device that couples the first ganging arm to the chair and defines the first pivot axis about which the first ganging arm pivots and a second mounting device that couples the second ganging arm to the chair and defines the second pivot axis that is parallel to the first pivot axis about which the second ganging arm pivots.

16. The chair according to claim 15, wherein the first mounting device has a first wear surface; wherein the second mounting device has a second wear surface; wherein the first ganging arm has an first inner surface that contacts the first wear surface as the first ganging arm pivots; and wherein the second ganging arm has an second inner surface that contacts the second wear surface as the second ganging arm pivots.

17. The chair according to claim 16, wherein the first wear surface and the second wear surface each include at least one bump that is configured to increase friction between the first wear surface and the first inner surface as the first ganging arm pivots and the second wear surface and the second inner surface as the second ganging arm pivots.

18. A chair comprising:

a frame having a plurality of legs;

a seat and a chair back each coupled to the frame, the seat including a seating surface that defines a horizontal seating plane and opposing side edges;

a ganging arm configured to pivot about a vertical pivot axis that is perpendicular to the seating surface, the ganging arm being movable between an operative position in which the ganging arm extends from one of the opposing side edges and a storage position in which the ganging arm is beneath the seat, the ganging arm having a ganging end that extends from one of the opposing side edges of the seat and an attachment end opposite the ganging end; and a mounting device that defines the vertical pivot axis;

wherein the attachment end is disposed on the mounting device such that the ganging arm pivots about the vertical pivot axis.

19. The chair according to claim 18, wherein the mounting device has a flange configured to retain the attachment end of the ganging arm on the mounting device; wherein the flange defines a set-pin hole; and further comprising a set-pin that is selectively disposed in the set-pin hole to thereby prevent the ganging arm from pivoting from the operative position to the storage position.

20. The chair according to claim 19, wherein the mounting device has a wear surface that extends along the vertical pivot axis; wherein the attachment end of the ganging arm includes an inner surface; wherein the inner surface contacts the wear surface as the ganging arm pivots; and wherein the wear surface has a bump that increases friction between the wear surface and the inner surface as the ganging arm pivots.

* * * * *